US009869325B2

(12) United States Patent
Witt

(10) Patent No.: US 9,869,325 B2
(45) Date of Patent: Jan. 16, 2018

(54) FAN BLADE

(75) Inventor: Henrik Witt, Hamburg (DE)

(73) Assignee: W & S Management GmbH & Co. KG, Pinneberg (DE)

( * ) Notice: Subject to any disclaimer, the term of this patent is extended or adjusted under 35 U.S.C. 154(b) by 952 days.

(21) Appl. No.: 13/321,398

(22) PCT Filed: May 19, 2010

(86) PCT No.: PCT/EP2010/003082
§ 371 (c)(1),
(2), (4) Date: Nov. 30, 2011

(87) PCT Pub. No.: WO2010/133354
PCT Pub. Date: Nov. 25, 2010

(65) Prior Publication Data

US 2012/0063906 A1 Mar. 15, 2012

(30) Foreign Application Priority Data

May 20, 2009 (DE) ..... 10 2009 022 181

(51) Int. Cl.
*F01D 5/30* (2006.01)
*F04D 29/38* (2006.01)

(52) U.S. Cl.
CPC ..... *F04D 29/388* (2013.01)

(58) Field of Classification Search
CPC . F01D 5/18; F01D 5/30; F01D 5/3023; F01D 5/181; F01D 5/183; F01D 5/14; F01D 5/141
USPC ..... 416/204 R, 210 R, 223 R, 224, 232, 416/229 R, 233
See application file for complete search history.

(56) References Cited

U.S. PATENT DOCUMENTS

| | | | | |
|---|---|---|---|---|
| 2,342,421 A | | 2/1944 | Moore | |
| 2,410,609 A | * | 11/1946 | Pecker | 244/123.9 |
| 2,596,781 A | * | 5/1952 | Moore | F04D 19/002 416/213 A |
| 3,229,935 A | * | 1/1966 | Bellanca | 244/123.5 |
| 3,231,022 A | * | 1/1966 | Schroeter | F04D 29/36 416/205 |
| 3,383,093 A | * | 5/1968 | Howald | 416/232 |
| 3,644,059 A | * | 2/1972 | Bryan | 416/97 R |

(Continued)

FOREIGN PATENT DOCUMENTS

| | | |
|---|---|---|
| DE | 1077369 B | 3/1960 |
| DE | 1628400 A | 7/1966 |

(Continued)

OTHER PUBLICATIONS

"High Temperature Alloys for Gas Turbines and Other Applications 1986 Part I" edited by Betz et al. p. 10, Fig. 13.*

(Continued)

*Primary Examiner* — Igor Kershteyn
*Assistant Examiner* — Kayla McCaffrey
(74) *Attorney, Agent, or Firm* — North Weber & Baugh LLP

(57) ABSTRACT

To improve upon a fan blade (6) with regard to the use of materials and the weight, in particular a fan blade for smoke venting fans, having fastening means (5) for fastening the fan blade (6) onto a fan hub as well as having a blade section (7), it is proposed that the blade section (7) shall have an outer jacket (8) enclosing a cavity.

13 Claims, 3 Drawing Sheets

(56) References Cited

U.S. PATENT DOCUMENTS

| | | | | | |
|---|---|---|---|---|---|
| 3,647,317 | A * | 3/1972 | Furlong | F04D 29/388 | 416/226 |
| 3,695,778 | A * | 10/1972 | Taylor | F01D 5/147 | 416/233 |
| 3,709,632 | A * | 1/1973 | Emmerson | F01D 5/184 | 416/229 R |
| 3,750,384 | A * | 8/1973 | Miller | G04G 9/10 | 368/82 |
| 4,040,769 | A * | 8/1977 | Britz | F04D 29/325 | 416/213 A |
| 4,172,691 | A * | 10/1979 | Comstock | F01P 7/06 | 416/132 A |
| 4,738,594 | A * | 4/1988 | Sato et al. | 416/224 | |
| 5,281,096 | A * | 1/1994 | Harris | F01D 11/008 | 416/193 A |
| 6,146,097 | A * | 11/2000 | Bradt | 416/5 | |
| 6,224,339 | B1 * | 5/2001 | Rhodes et al. | 416/224 | |
| 6,250,886 | B1 * | 6/2001 | Immell | F04D 29/388 | 416/214 R |
| 6,575,817 | B2 * | 6/2003 | Czech | F01D 5/288 | 134/8 |
| 7,063,763 | B2 * | 6/2006 | Chapman, Jr. | 156/175 | |
| 7,252,478 | B2 * | 8/2007 | Aynsley | 416/204 R | |
| 7,360,993 | B2 * | 4/2008 | Fraenkel | F03B 17/061 | 415/232 |
| 7,785,076 | B2 * | 8/2010 | Morrison et al. | 416/233 | |
| 8,162,613 | B2 * | 4/2012 | Oleson | F04D 25/088 | 416/210 R |
| 2004/0131470 | A1 | 7/2004 | Boyd | | |

FOREIGN PATENT DOCUMENTS

| | | | |
|---|---|---|---|
| DE | 1428280 | A1 | 6/1969 |
| DE | 1950139 | A | 10/1969 |
| DE | 1585148 | C | 7/1970 |
| DE | 2242218 | A1 | 9/1973 |
| DE | 3707437 | A1 | 3/1987 |
| DE | 3941612 | C2 | 12/1989 |
| DE | 4234292 | A1 | 10/1992 |
| DE | 19700193 | A1 | 1/1997 |
| DE | 19733165 | A1 | 7/1997 |
| DE | 10038264 | C1 | 8/2000 |
| DE | 10137601 | A1 | 8/2001 |
| DE | 102009022191 | B3 | 5/2009 |
| GB | 706076 | A | 3/1954 |

OTHER PUBLICATIONS

English translation of International Search Report dated Oct. 26, 2010, in related International PCT Application No. PCT/EP2010/003082, filed May 19, 2010.

English translation of Written Opinion dated Oct. 26, 2010, in related International PCT Application No. PCT/EP2010/003082, filed May 19, 2010.

English translation of International Preliminary Report on Patentability dated Oct. 26, 2010, in related International PCT Application No. PCT/EP2010/003082, filed May 19, 2010.

English Translation of Search Report dated Mar. 11, 2010, in re priority German Patent Application No. 10 2009 017 307.2 (3pgs).

Examination Report dated Mar. 16, 2016, in Australian Application No. 2015202728 (4pgs).

* cited by examiner

FAN BLADE

CROSS REFERENCE TO RELATED APPLICATIONS

This application is the National Phase Application under 35 USC §371 of International Application No. PCT/EP2010/003082, filed May 19, 2010, which claims priority to German Patent Application 10 2009 022 181.6, filed May 20, 2009.

BACKGROUND

A. Technical Field

The present invention relates to a fan blade in particular for smoke venting fans having fastening means for fastening the fan blade to a fan hub and to a blade section.

B. Background of the Invention

Fans for the subway or tunnels and/or closed buildings for vehicles, such as underground garages, must operate reliably under a wide variety of load and ambient conditions for a very long service life. The installation of fans in subways or tunnels or underground garages is typically designed for operation for a period of several years or decades. In particular when using fans as smoke venting fans in subways or tunnels, there are requirements of the operability of the fan at high temperatures, such as those which occur in fires in particular, on the part of the metro operator or tunnel operator. Some of these requirements are set by law. On the other hand, as is customary in general, there is a desire to manufacture the fans in the most favorable possible manner and with savings of materials.

In general, fans in their basic design consist of a fan hub, to which a number of fans blades are attached radially. The fan blades are fastened to the hub by fastening means such as bolts.

Against the background of the general requirements of fans described here, various fan blades are conceivable. To keep the weight low, fan blades may be made of solid aluminum or an aluminum alloy. However, one disadvantage of fan blades made of aluminum is their limited usability at temperatures above approx. 300° C., because the tensile strength of aluminum drops sharply at such temperatures, so that aluminum gradually begins to flow. Even special aluminum alloys are unable to significantly improve upon this unsuitability. As a result of this negative property of aluminum, fan blades may change their shape and/or length at high temperatures, such as those which may occur in fires, for example, thus greatly impairing their use as intended in fires or even making it impossible.

Based on this inadequacy of fan blades made of aluminum, solid fan blades made of steel are used in the state of the art for smoke venting fans exposed to high loads, for example, at high speeds and/or large fan lengths. Fan blades made of steel have the disadvantage, however, of having a very high mass and being expensive to manufacture because of the high use of material.

SUMMARY OF THE INVENTION

The object of the present invention is therefore to provide a fan blade of the type defined in the introduction which can be used without restriction even at high temperatures such as those which may occur in tunnel fires without requiring the fan blades to have an undesirable high weight.

According to the invention, this object is achieved with a fan blade of the type defined in the introduction in that the blade section has an outer jacket enclosing a cavity. According to the invention it is thus provided that the blade section of the fan blade is not completely solid as in the state of the art. This directly yields savings of material and weight.

To improve the stability of the inventive fan blade in particular its tensile strength, a supporting element may be arranged in the cavity in an advantageous embodiment of the invention.

In particular in another preferred embodiment of the invention the supporting element is shaped in one piece with the fastening means. In this way the unit of the fastening means and the supporting element arranged in the cavity of the fan section can absorb all tensile forces during operation. The outer jacket of the blade section primarily fulfills aerodynamic functions according to this advantageous embodiment of the invention. In this way a material that has been optimized for the purposes of fastening the fan blade onto the fan hub in a manner that provides tensile strength may be selected to advantage and at the same time, regardless of the preceding, a material optimized for the aerodynamic shaping of the fan blade may be selected. The supporting element in particular may be made of a material having a high hot tensile strength and a good creep behavior at high temperatures. At the same time, a lightweight outer jacket of the fan blade made of a suitable steel alloy, for example, may be selected according to the invention without thereby impairing the strength of the fan blades as a whole. However, other materials or alloys based on titanium, for example, may also be used within the scope of the invention.

In a particularly favorable embodiment of the invention, if the supporting element is made essentially of a steel alloy and/or a titanium alloy, this yields the advantage that the hot tensile strength and the creep behavior of the fan blade are especially high. This is the case with steel alloys in particular because the hot tensile strength and the creep behavior of steel are excellent even at temperatures above 300° C., for example. In particular the hot tensile strength at the aforementioned temperatures is much better than that of aluminum.

In another advantageous embodiment of the invention, the supporting element may have a modular design consisting of several individual elements that can be connected to one another by a plug connection in particular. The modular design of the supporting element permits an especially inexpensive manufacturing method based on standardized individual components which can be adapted to different types of fans. From the standpoint of the manufacturing technology, the modular design also allows the use of standardized components for a wide variety of fan blades, in particular with regard to length.

In another embodiment of the invention, it is especially advantageous if the supporting element has one or more profile chords that are adapted to the shape of the outer jacket. The profile shape of the fan blade can be implemented in this way in terms of the manufacturing technology by means of form-fitting bending of the outer jacket to the profile chords. This advantageously ensures that the aerodynamic profile of the fan blade will be retained even at high temperatures.

In another preferred embodiment of the invention, the cavity is filled with a foamy filler compound. The foamy filler compound should expediently have a low mass and/or density. The outer jacket may advantageously be supported by the foamy filler compound according to the invention to retain the aerodynamic profile in this way. For example, this effectively prevents bulging of the outer jacket in the areas between profile chords of the supporting element. Furthermore, due to the fact that the cavity is filled with a foamy filler compound, this advantageously prevents liquids from collecting in the cavity. The accumulation of liquids in the cavity would undesirably increase the effective mass of the fan blade. Furthermore, introducing water into the cavity would lead to the risk of corrosion. Furthermore, the vibrational behavior and the damping of the blades are improved by filling them with foam. All of this is effectively suppressed by filling the cavity with the foamy filler compound. A foam that can be prepared from two components has proven to be suitable in particular as a filler compound.

If the outer jacket is provided with at least one throughhole into the cavity in another embodiment of the invention, this yields a further advantageous embodiment of the invention. If the borehole is provided on the outer end of the fan blade radially, then any liquid entering the cavity is discharged out of the cavity during operation due to the centrifugal force. This advantageously prevents an unwanted increase in the mass of the fan blade due to condensate accumulating in the interior with the resulting increase in the risk of corrosion. Providing a borehole on the inner end of the fan blade radially makes it possible in particular to check on internal welds, for example, by endoscopic methods. This is advantageous if the outer jacket has been welded to the supporting element.

Another advantageous embodiment of the invention provides that the outer jacket is provided with anticorrosion protection on the cavity side and/or is manufactured essentially from a steel alloy. These two measures, either alone or in combination, yield a definite improvement in the corrosion resistance of the outer jacket. This in turn makes it possible to design the outer jacket with thin walls. For example, it may be sufficient for the material of the outer jacket to be 1 mm thick.

In another embodiment of the invention, the outer jacket consists of two or more plate-shaped jacket elements joined together.

The torsional strength of the inventive fan blade is improved in particular in an advantageous embodiment of the invention when the outer jacket is provided with reinforcing elements to reinforce the fan blade on the outside.

The reinforcing means may be arranged on a high pressure side and/or on a low pressure side of the outer jacket in another embodiment. For example, the reinforcing means may be designed to be stronger on the low pressure side than on the excess pressure side.

The invention will now be described on the basis of an example of a preferred embodiment with reference to a drawing, where additional advantageous details can be derived from the figures of the drawing.

BRIEF DESCRIPTION OF THE DRAWINGS

The invention is described by way of example in one preferred embodiment, with reference to the drawing; further advantageous particulars of the figures are contained in the drawing.

Parts having the same function are labeled with the same reference numerals.

The drawings in the figures show in detail:

Figure 1:
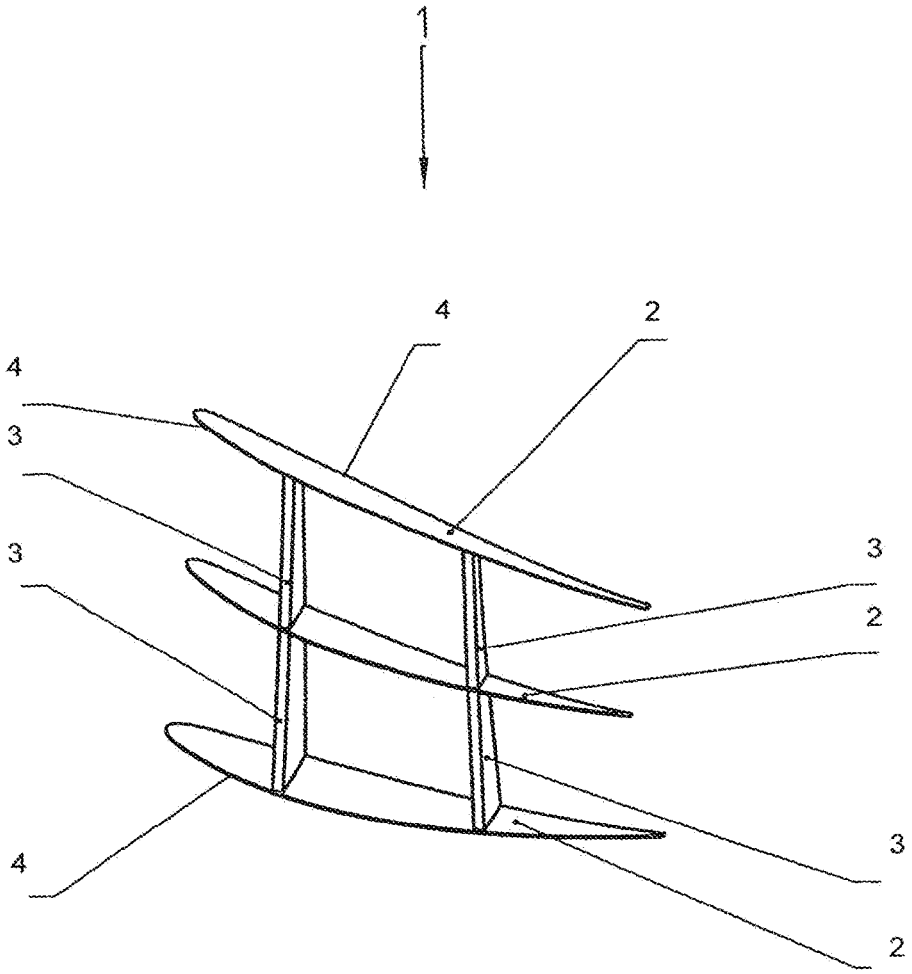

FIG. 1 a supporting element for an inventive fan blade in a perspective view;

FIG. 2 an inventive fan blade (a) in an axial view and (b) in a radial sectional view;

FIG. 3 inventive fan blade in an alternative embodiment, the views corresponding to those of FIG. 2.

DETAILED DESCRIPTION OF THE PREFERRED EMBODIMENTS

FIG. 1 shows a steel supporting structure 1 in a perspective view. The steel supporting structure 1 is constructed of a total of three profile chords 2. The profile chords 2 are joined together by a plug connection via two cross struts 3. The profile chords are joined to one another by the cross struts 3 such that twisting of the profile of a fan blade manufactured from the steel supporting structure 1 by applying an outer jacket to peripheral edges 4 of the profile chord 2 is created. The profile chord 2 in the foreground in this figure is connected to a fastening bolt 5. This cannot be seen in FIG. 1. The fastening bolt 5 serves to fasten the fan blade to the steel supporting structure 1 which is shown in FIG. 1 in a fan hub (not shown).

Figure 2A:
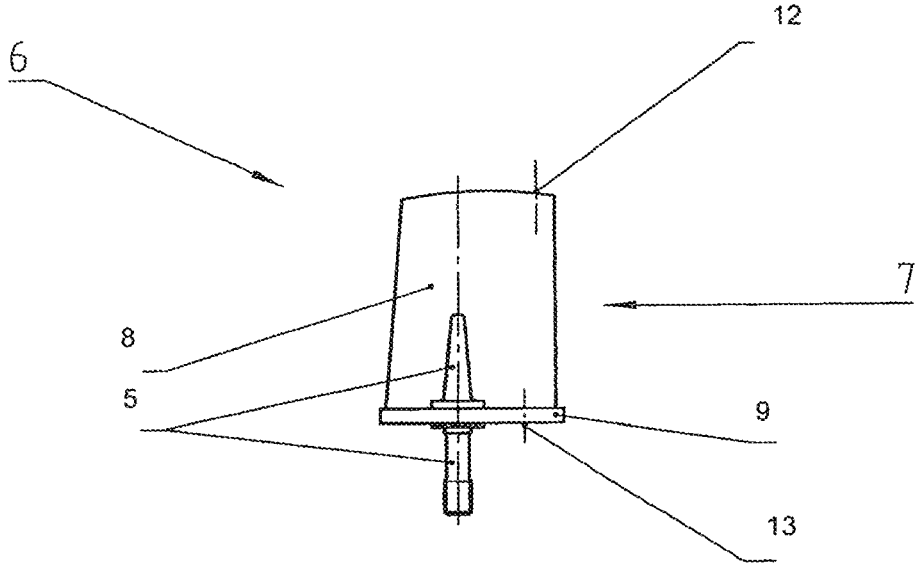
Figure 2B:
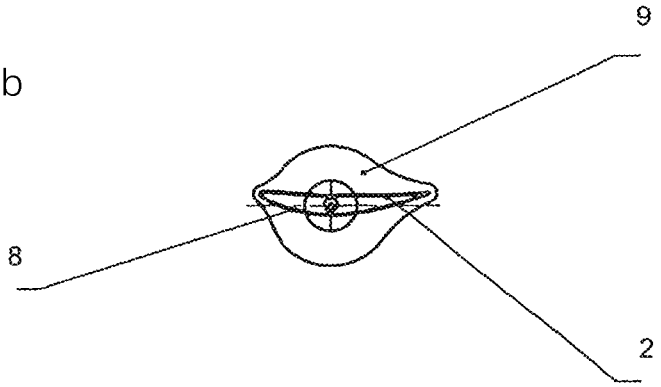

FIGS. 2*a* and 2*b* show an inventive fan blade 6. The fan blade 6 has the fastening bolt 5 on the inside radially as already mentioned in conjunction with FIG. 1. The fan blade 1 has a blade section 7. The blade section 7 consists of an outer jacket 8. The outer jacket 8 is manufactured from a number of individual plates made of steel where the material has a thickness of 1 mm. The steel plates are attached by welding to the peripheral edges 4 of the profile chord 2 of the steel supporting structure 1. The outer jacket 8 surrounds a cavity in this way. The cavity is partially filled with the steel supporting structure 1. The remaining cavity may be filled with a filler compound. The radial view from above according to part (b) of FIG. 2 shows the aerodynamic profile of the fan blade 6 especially clearly. It can also be seen here that a base plate 9 separates the blade segment 7 from the fastening bolt 5. The fastening bolt 5 runs through the base plate 9.

In the radial view from above according to FIG. 2(*b*), it can be seen clearly that the profile of the outer jacket 8 corresponds to the profile of the profile chord 2 of the steel supporting structure 1 according to FIG. 1. The steel supporting structure 1 is preferably made of steel. The outer jacket 8 may be made of a steel alloy.

A drainage hole 12 may be provided in the outer jacket 8 on the outside radially. Furthermore, an endoscopy hole 13 may be provided in the outer jacket 8 on the inside radially.

Figure 3A:
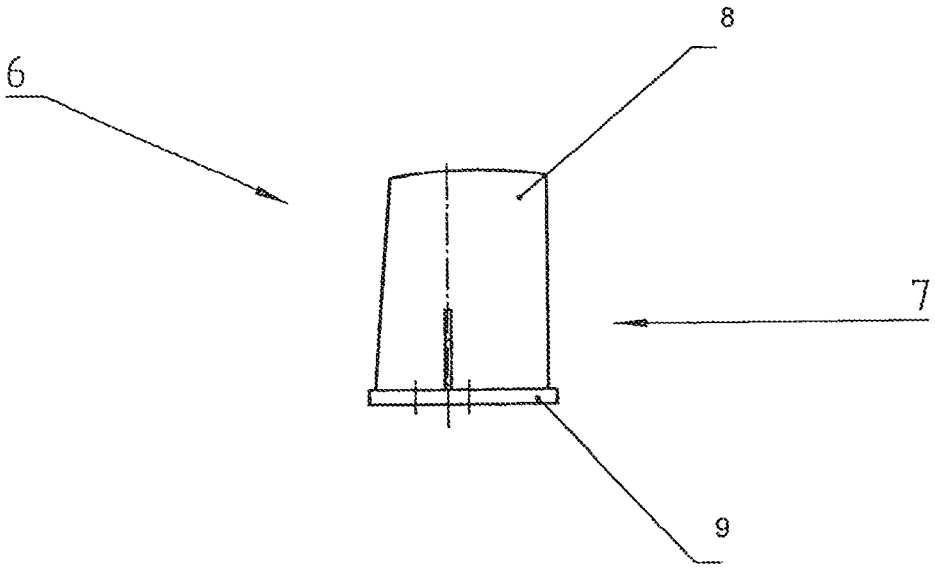
Figure 3B:
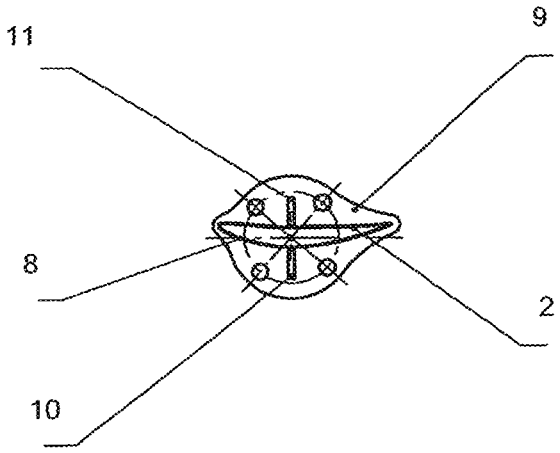

FIGS. 3*a* and 3*b* show an alternative embodiment of an inventive fan blade. However, this diagram and the basic structure correspond essentially to those in FIG. 2. The aforementioned blade 6 according to FIG. 3 is additionally provided with supporting plates 10, 11. The supporting plates 10, 11 are essentially perpendicular to the base plate 9. On the other hand the supporting plates 10, 11 stand with their outer edge essentially at a right angle on the surface of the outer jacket 8. The supporting plates 10, 11 are thus essentially radially oriented but are oriented so they are rotated by 90° essentially in relation to the outer jacket 8 of the blade section 7. The supporting plate 11 on the excess pressure side is thicker than the supporting plate 10 on the reduced pressure side. The supporting plates 10, 11 may also be connected.

On the basis of FIGS. 1 to 3 the design of an inventive fan blade 6 is thus diagramed. The inventive fan blade 6 is characterized in that an outer jacket 8 made of a steel alloy, for example, is welded to a steel supporting structure 1. The welding is preferably performed along the peripheral edges 4 of the profile chords 2 of the steel supporting structure 1. In this way the outer jacket 8 surrounds a cavity in which the steel supporting structure 1 is arranged. The remaining cavity may be filled with a filler substance according to the invention. This yields a particularly lightweight embodiment of a fan blade, which can be produced by a method that saves on materials but nevertheless yields a product having tensile strength by the method described here within the scope of the invention.

Within the scope of the invention, a titanium alloy or some other material may also be used instead of steel.

LIST OF REFERENCE NUMERALS

1 Steel supporting structure
2 Profile chord
3 Cross strut
4 Peripheral edge
5 Fastening bolt
6 Fan blade
7 Blade section
8 Outer jacket
9 Base plate
10 Supporting plate
11 Supporting plate
12 Drainage hole
13 Endoscopy hole

What is claimed is:

1. A smoke venting fan blade comprising:

a base plate having first and second flat surfaces;

a fastener extending through the first and second flat surfaces and being configured to fasten the smoke venting fan blade directly to a fan hub; and a blade section comprising an outer jacket enclosing a cavity, the cavity comprising a supporting structure that is configured to absorb tensile forces acting on the smoke venting fan blade and to withstand temperatures of at least 300° C., wherein the supporting structure comprises one or more profile chords that are adapted to the shape of the outer jacket, the supporting structure being manufactured from at least one of a steel alloy and a titanium alloy, and wherein portions of the supporting structure are affixed to each other in a modular design.

2. The fan blade according to claim 1, wherein the outer jacket comprises at least one through-hole extending into the cavity.

3. The fan blade according to claim 1, wherein the outer jacket is treated with anticorrosion protection on the inside of the cavity side.

4. The fan blade according to claim 1, wherein the outer jacket is welded to edges of the one or more profile chords.

5. The fan blade according to claim 1, wherein the outer jacket is manufactured from a steel alloy.

6. The fan blade according to claim 1, wherein the outer jacket comprises at least one drainage hole extending into the cavity.

7. The fan blade according to claim 1, wherein the outer jacket is welded to the supporting structure.

8. The fan blade according to claim 1, wherein the smoke venting fan blade is releasably fastened to the fan hub.

9. The fan blade according to claim 1, wherein the base plate comprises reinforcing elements, the reinforcing elements supporting a surface of the outer jacket to reinforce the fan blade.

10. The fan blade according to claim 9, wherein the reinforcing elements are arranged on a high pressure side or on a low pressure side of the outer jacket.

11. The fan blade according to claim 9, wherein the reinforcing elements are arranged perpendicular to the base plate.

12. The fan blade according to claim 9, wherein the reinforcing elements and the surface of the outer jacket are essentially perpendicular relative to each other.

13. The fan blade according to claim 9, wherein the reinforcing elements are designed to withstand a greater force on a low pressure side of the outer jacket than on a high pressure side of the outer jacket.

* * * * *